US005675939A

United States Patent [19]

Hickner

[11] Patent Number: 5,675,939

[45] Date of Patent: Oct. 14, 1997

[54] RAINWATER DIVERTER FOR SLOPED ROOF FLASHINGS

[76] Inventor: Andrew J. Hickner, 1271 N. Wwy. 288-B, Richwood, Tex. 77531

[21] Appl. No.: 618,360

[22] Filed: Mar. 19, 1996

[51] Int. Cl.[6] ..... E04D 13/14

[52] U.S. Cl. ..... 52/58; 52/60; 52/62; 52/13

[58] Field of Search ..... 52/11, 13, 58, 52/60, 61, 62, 94, 96, 412

[56] References Cited

U.S. PATENT DOCUMENTS

| | | | |
|---|---|---|---|
| 1,885,640 | 9/1932 | Moore . | |
| 1,927,881 | 9/1933 | Wetmore . | |
| 3,698,142 | 10/1972 | Theriault . | |
| 4,391,068 | 7/1983 | Kosar . | |
| 4,449,333 | 5/1984 | Stratton . | |
| 4,594,819 | 6/1986 | Kneisel . | |
| 4,781,008 | 11/1988 | Lyons . | |
| 5,077,943 | 1/1992 | McGady | 52/58 |
| 5,109,641 | 5/1992 | Halan . | |
| 5,333,419 | 8/1994 | Hickner . | |

*Primary Examiner*—Wynn E. Wood
*Assistant Examiner*—Yvonne Horton-Richardson

[57] ABSTRACT

An improved rainwater diverter for use as the terminal portion of roof flashing is disclosed for covering the abutment of a vertical wall and a sloped roof. The flashing comprises essentially twin, bilaterally symmetrical flanges of which either is adaptable for use as a vertical wall flange that lies in a plane which is essentially normal to the plane of the sloped roof flange. There is provided at the lower portion of the flashing, as an integral part thereof, a diverter part which spans the part of the flashing which lies along the vertical wall above the abutment and the part which lies along the sloped roof and lies at an obtuse angle to each of the said flanges. The upper surface of the diverter is an essentially triangular part with its uppermost corner integral with the flashing at the juncture of the wall part and the roof part, with the two lowermost corners joined at or near the lower edges of the wall part and the roof part in a manner which directs water falling from the flashing away from the wall.

16 Claims, 2 Drawing Sheets

RAINWATER DIVERTER FOR SLOPED ROOF FLASHINGS

FIELD OF THE INVENTION

A rainwater diverter of bilateral symmetry is used as the lowest portion of a roof flashing at the juncture of a sloped roof and a vertical wall.

BACKGROUND OF THE INVENTION

At the juncture of a sloped roof where it abuts a portion of a vertical wall, there is ordinarily a flashing used to cover the juncture to prevent water from leaking down through the juncture where the vertical wall meets the sloped roof. The flashing comprises a wall flange which is mostly hidden from view beneath the wall covering and a roof flange which is mostly hidden from view by the roof covering. The two flanges, generally made of a single strip of waterproof material bent along its length at approximately a right angle, are purposely made leakproof to prevent rainwater away from getting into the line of abutment of the roof and wall. In the vernacular of the trade it is often referred to as a step gable/wall flashing. Such flashing often comprises a series of flashing members arranged in stepped manner, each lower member being inserted an effective distance beneath the next higher member in the same manner that roofing shingles or tiles are positioned; this provides cascading of water as it flows from one overlapping portion, in turn, to the lower overlapped portion. If the wall covering and the roofing each comprises a contiguous overlay of a continuous flashing, then there may be only one lower step of flashing member positioned as the lowest part of the overall flashing arrangement. At the lowest point of the flashing arrangement, water can flow onto the wall unless there is provided a means for diverting the water away from the wall beyond the lowest portion of the flashing.

The valley at the juncture of two sloping roofs does not generally present the same problem since the lower edges of the two sloping roofs are usually offset by eaves from the walls beneath them. There is, however, a problem at the juncture of a vertical wall and a sloping roof if the vertical wall extends beyond the eave of the sloping roof. There rainwater flowing down the flashing often flows onto the portion of the wall which protrudes beyond the edge of the sloping roof where it can create stains, rotting, discoloration or other problems, depending on the type of material covering the wall at that point. Conventional means do not adequately prevent rainwater, flowing down the flashing, from falling onto the vertical wall at the end of the flashing, especially if there is wind blowing the rainwater against the vertical wall. Debris, e.g. dirt, soot, leaves etc., being washed down the flashing by the rainwater can create stains on the vertical wall which can be worse than stains caused by rainwater alone.

The problem referred to above is addressed in U.S. Pat. No. 5,109,641 which discloses a terminal flashing part for use at the low end of a juncture of a sloped roof with a vertical wall. The patent discloses, at the low end of the flashing, an offset in the part of the flashing bent at right angles (said to be "L-shaped") for the purpose of diverting rain away from the vertical wall portion which extends beyond the juncture with the sloping roof. Behind that offset in the flashing is a space provided for inserting an end of a strip of wall siding, thus that offset portion is visible when installed in position and with the siding in place. The bent portion disclosed there forms a right angle corner at the low end of the flashing, nearest the vertical wall, which can collect leaves and dirt. A collection of leaves and dirt holds moisture and the moisture can cause accelerated rusting or other degradation of the flashing material, e.g., galvanized metal. Such rusting or degradation tends to shorten the useful life of the right angle diverter and can permit water to flow onto the vertical wall below the low end of the flashing.

In my U.S. Pat. No. 5,333,419 I disclose a rainwater diverter for sloped roof flashings which is specifically designed, in one instance for use where the sloped roof joins with a vertical wall at its "left" end, and in another instance where the rainwater diverter is designed in essentially a mirror image manner for use where the sloped roof joins with a vertical wall at its "right" end. The unsymmetrical diverter for use at the "left" end of the sloped roof does not function as efficiently if used on the "right" end and vice versa.

It is an object of this invention to provide a rainwater diverter of bilateral symmetrical construction at the low end of the flashing that is slanted in a manner to direct rainwater away from the vertical wall and which does not collect dirt or other moisture-retaining debris and also which functions equally well on either the left side or the right side of the end of the sloped roof eave where it joins a vertical wall that has wall portions extending downwardly and outwardly from the low edge of the sloped roof eave. The diverter of the present disclosure can be viewed as being essentially of bilateral symmetry in design with respect to its location at the low end of the flashing where a sloped roof abuts a vertical wall on either end of the sloped roof. Two identical rainwater diverters of bilateral symmetry can be used equally well on both ends of the sloped roof eave where each end abuts a vertical wall.

It is also an object to provide a symmetrical rainwater diverter at the low end of the flashing which permits the wall covering and the roof covering to cover substantially all of the flange portions of the flashing, leaving visible only a small amount of flashing, including the diverter, providing an esthetically attractive and beneficial covering of the juncture of the roof and wall.

It is a further object to provide a flashing with a symmetrical diverter which can be made of a variety of materials, including, but not necessarily limited to, galvanized metal, corrosion resistant metal, plastic, copper, anodized aluminum, ceramic, resin-impregnated fiberglass, vitreous material, roofing tile clay, composition roofing material, impervious bonded mineral fibers, and the like.

A still further object is to provide a flashing with a symmetrical diverter which guides rainwater away from a vertical wall and does so without providing configurations which permit a buildup of debris from collecting on the diverter.

In the descriptions herein of the symmetrical diverter flashing portions, references such as "low" and "upper" refer to the portions of the flashings when installed as the lowest piece of the flashing members in cooperation, in overlapping series, above it. It will be understood that the term "bilateral symmetry" refers to the similarity of the two flanges as viewed by taking the line of juncture of the two halves or "flanges" as the central line of the bilateral symmetry.

Also, as used herein the expressions "essentially normal", "substantially normal", are used to indicate that the parts of the bilateral symmetrical diverter being referred to are at right angles (90°), or are very near to being at right angles.

SUMMARY OF THE INVENTION

The present invention provides a rainwater diverter for use as the lowest portion of flashing members at the juncture of a vertical wall and the edge of a sloping roof. This rainwater diverter flashing portion comprises two flanges that lie in planes which are essentially at right angles to each other, joined at a line with respect to which the flanges are viewed as being of bilateral symmetry. The diverter part comprises a triangular portion as an integral part of the flashing, with the upper corner of the triangular portion being contiguous with the bilateral line of symmetry. The diverter part lies in a plane which is at an obtuse angle with both the planes of the symmetrically positioned flanges, when viewed from its top side, and the two lower corners extend symmetrically to the lower edges of the symmetrical flanges. Provision is made for having flange members positioned behind the diverter, normally out of sight when installed on the roof, to obstruct rain, dirt, or other debris from being carried by the wind into the area behind the diverter.

BRIEF DESCRIPTIONS OF THE DRAWINGS

FIGS. 1–6, none of which are drawn to any particular scale, provide visual aids in relating the symmetrical rainwater diverter of the present invention.

Figure 3:
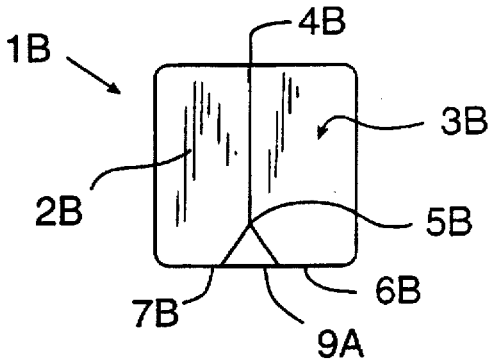

FIG. 3 is a frontal view of the symmetrical twin flanges with the diverter shown at the lower portion. Also, this view demonstrates that the configuration of the flanges can vary somewhat, as seen by the more rounded edges which are useful in avoiding cuts and scratches to installers. Also, the twin flanges are shown as having the outside edge of flange 2B on the left as being parallel to the outside edge of flange 3B on the right, as a variation of the apparent shape of the twin flanges of FIG. 1 in which the outside edges of the flanges are not depicted as being parallel to each other.

Figure 4:
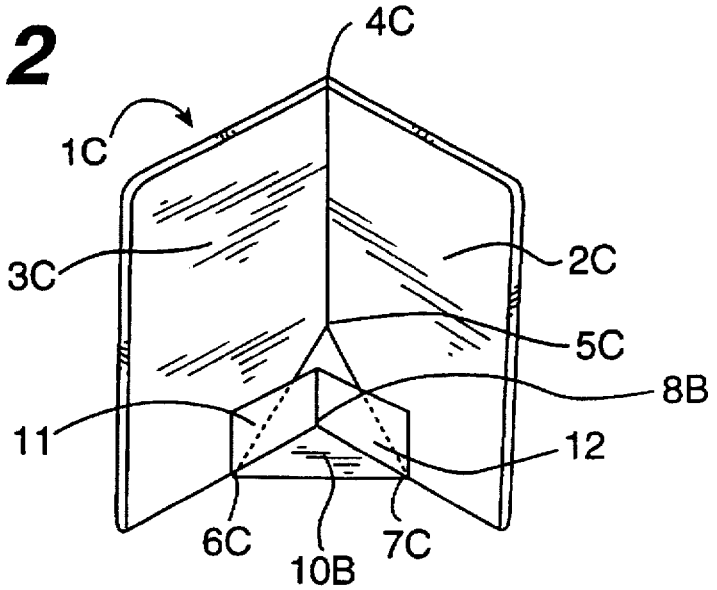

FIG. 4 is an oblique view to show the configuration from behind to show portions of the diverter which are normally hidden from sight when installed in service, but which cooperate with the obstruction of wind-blown rain and debris from getting up behind the diverter.

Figure 5:
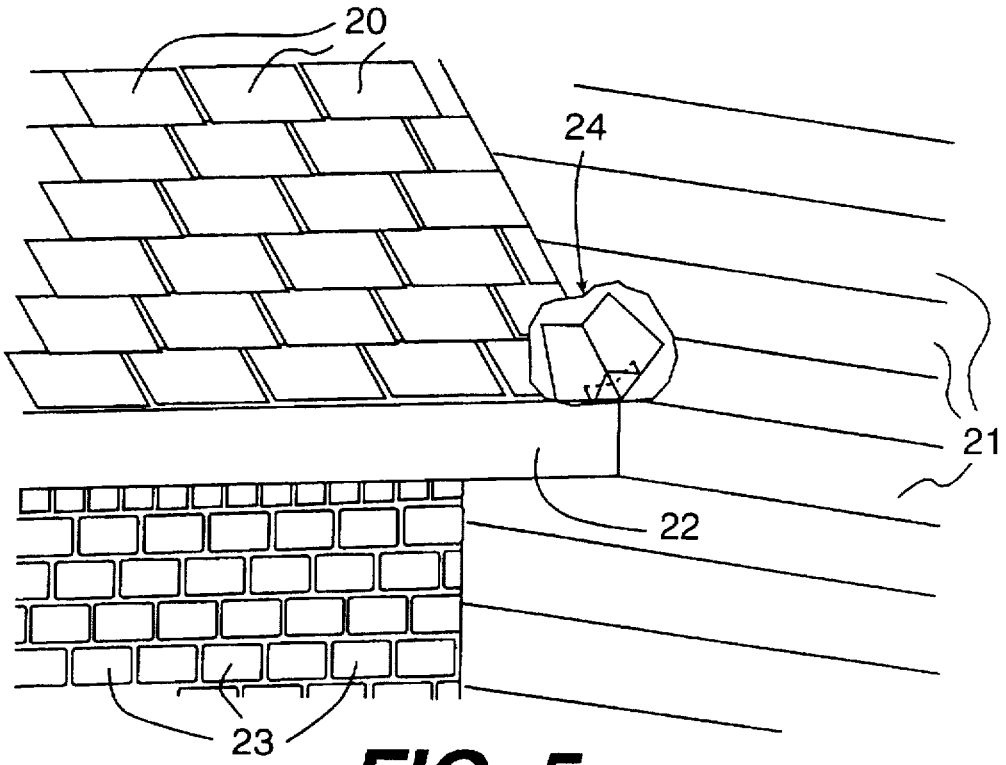

FIG. 5 demonstrates a diverter installed on the right-hand end of the sloped roof at the eave where it meets a vertical wall.

Figure 6:
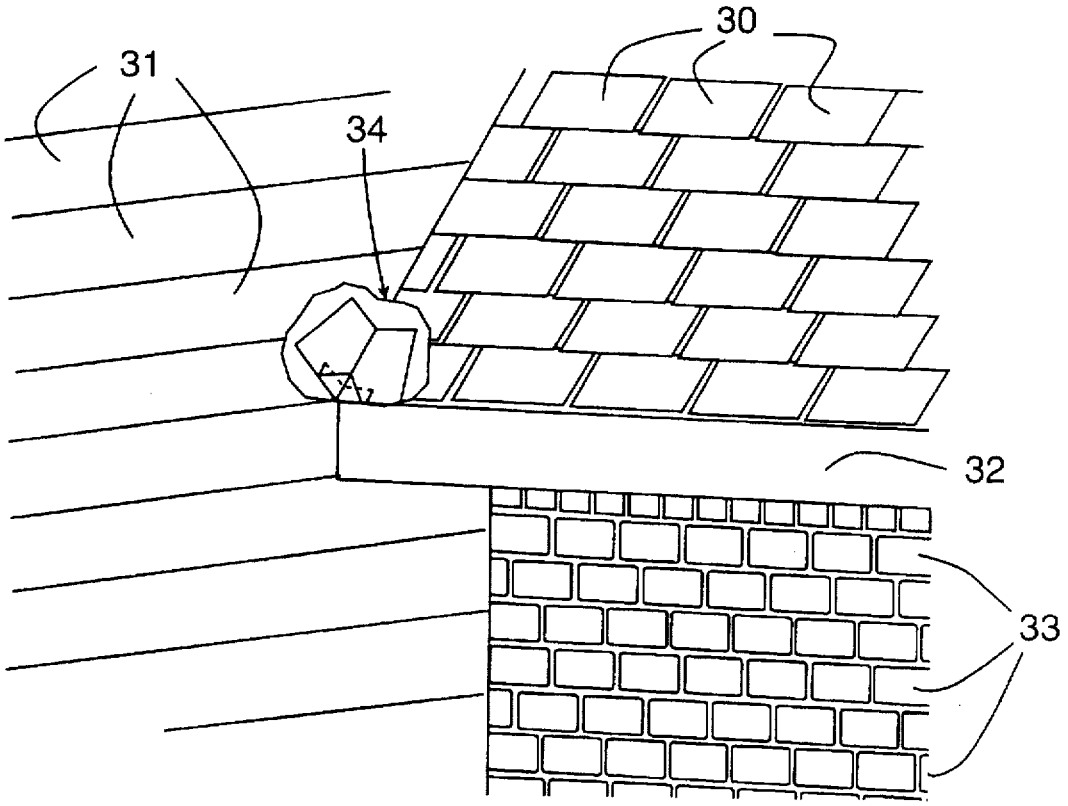

FIG. 6 demonstrates a diverter installed on the left-hand end of the sloped roof at the eave where it meets a vertical wall.

Thus, FIGS. 5 and 6 show that the same diverter of the present invention can be used on either the left or the right side of the sloping roof where it is joined to a vertical wall.

DETAILED DESCRIPTIONS OF DRAWINGS

Figure 1:
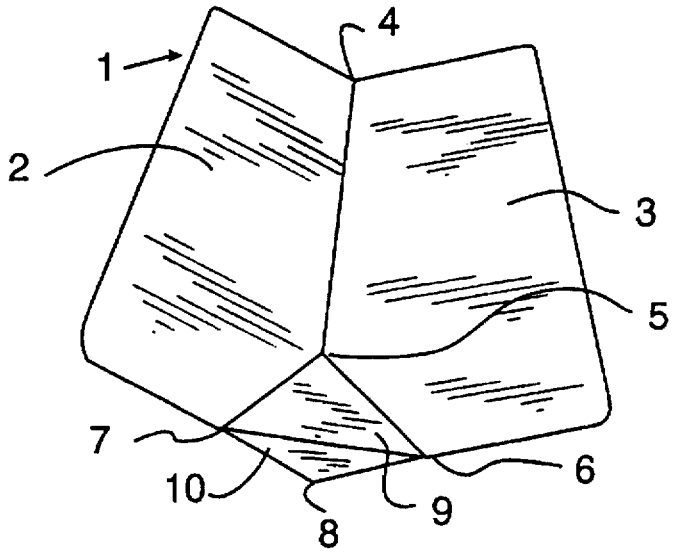
FIG. 1 is an oblique view of the triangular diverter bridging the lower portion of two symmetrical flanges integrally joined at right angles to each other, with the diverter being integrally joined at obtuse angles to each of the flanges. Here, the points 4, 5, and 8 define the line for defining the bilateral symmetry of the rainwater diverter flashing.

FIG. 1 is a view of a diverter of the present invention, signified generally by the number 1, which has a first flange 2 and a second flange 3 which meet at an angle of essentially 90° along a line defined between points 4-5 in connection with a triangular surface 9 defined by points 5-6-7. The two flanges are preferably made by bending a piece of the flange material, but with some materials it may be necessary to join two separate flanges to form an integral leak-proof bond. The triangular surface 9 is in a plane which is at an obtuse angle with respect to the two main flanges at the juncture points; this surface is the principal diverter of rainwater at the lower end of the flashing. The lower edge defined by points 6-7 of triangular surface 9 is in co-extensive, leak-proof, connection with triangular flange surface 10, defined by points 6-7-8 which lies in a plane essentially about normal to the respective planes of the main flanges 2 and 3. Behind the main flanges there are preferably used auxiliary flange means, such as shown in FIG. 4, which provide barriers for preventing wind-blown rain or debris from entering the areas behind the diverter when installed on a roof. In maintaining the bilateral symmetry of the total structure, it is critical that the triangular surface 9 be intentionally positioned symmetrically with respect to the line 4-5 just as flanges 2 and 3 are. It is helpful to consider flange 10 as being a "face" which is seen by a person standing beneath, and looking upward at, an installed diverter of the present invention.

Figure 2:
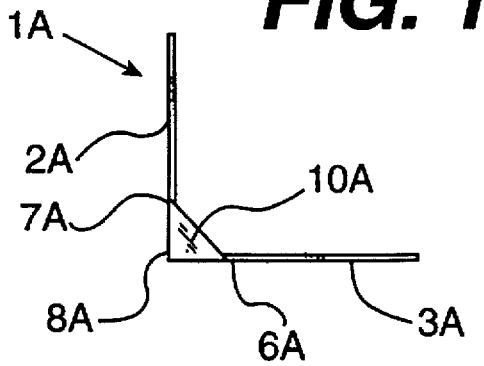
FIG. 2 is an end view of a configuration as in FIG. 1 to show the bottom side of the diverter and to illustrate that the flanges are at right angles to each other, but at obtuse angles to the diverter portion which spans the lower portion of the integrally joined flanges.

FIG. 2 provides a lower end view 1A of the structure shown in FIG. 1, where triangular part 10A is defined by points 6A-7A-8A (the "face") and the relationship with flanges 2A and 3A is demonstrated.

FIG. 3 provides a frontal, erect view 1B of a structure essentially the same as in FIG. 1, with the triangular part 9A, defined by 5B-6B-7B illustrated from that perspective. Note that the exact shape of flanges 2B and 3B are illustrated to be not precisely like that of FIG. 1, thus demonstrating that some variation of the flanges can be used. In that regard, one may or may not have rounded corners on the devices, but it is preferable to have rounded corners which are helpful in avoiding cuts and scrapes to roofers, especially if the material of construction is thin metal. It is not necessary to have the twin flanges built exactly the same as that of another pair of twin flanges, so long as they are of a size suitable for directing the flow of rainwater flowing down the slope flashing to the triangular diverter portion 9A.

FIG. 4 provides a backside oblique view of flanges such as those of FIGS. 1, 2, and 3, to describe the use of small flanges 11 and 12 which will normally be out of view when the presently described device is installed as the lower portion of the flashing where a slanted roof abuts a vertical wall. The low edge of small flange 11 is contiguous with points 6C and 8B, and small flange 12 is contiguous with points 7C and 8B. These two small flanges meet at a juncture with the lower end of the juncture being at point 8B. In FIG. 4, the dotted lines illustrate the hidden portions of lines defined by 5C–6C and 5C–7C; these are shown as being partially hidden by flanges 11 and 12. It will be understood that flanges 11 and 12 can be made somewhat taller, in the direction of point 4C.

FIG. 5 is a view of a diverter 24 of the present invention when positioned with one of its flanges positioned in place at the right end of a sloped roof eave 22, and the other flange positioned in place on a vertical wall, portions of the roofing material 20 being "cut away" to reveal the diverter beneath it. Also shown depicted there is a brick wall, but the showing of bricks 23 is merely to distinguish from the siding material 21 of the vertical wall. The invention is not limited as to the materials which comprise the roof covering or the vertical covering.

FIG. 6 is essentially a mirror image of that which is shown in FIG. 5, to illustrate that the same diverter configuration 34 can be used at the left end of the eave 32 of sloped roof and positioned in place against the vertical. Here, as in FIG. 5 above, the shingle material 30 of the sloped roof can be virtually any roof covering and the vertical wall can be made of virtually any siding 31. Furthermore, the depiction of bricks 33 is done is to make a clear distinction between the building beneath the sloped roof and the vertical wall which abuts the sloped roof.

FURTHER DESCRIPTIONS INCLUDING BEST MODE CONTEMPLATED

In the practice of the present invention, one may select a wide variety of materials of construction for the present flashing diverter which would be expected to not only provide long-term protection against rain and weather, but also provide a good aesthetic match with the materials used in the roof covering and the wall covering. One may prepare the flashing to match a tile roof, a composition roof, wood siding, brick siding, aluminum siding, vinyl siding, or ceramic siding such as transite material.

There are a number of methods and procedures by which the flashings of this invention can be formed, mostly depending on the material chosen. In the case of commonly used galvanized metal flashing material, one can even make predetermined measurements and cuttings from flat stock and then bend along predetermined lines to effect a unitary structure, which in some cases may require soldering of some edges to prevent water from leaking through where two edges meet. This can even be performed in the field by roofers. One can also cut and bend flat stock to form the wall flange and roof flange portions and then solder or otherwise fasten the diverter in place in a manner which avoids leakage at the point of the solder or other fastener, even when the diverter has a "face" covering the area under, and behind, the diverter to prevent wind blown rain from getting in up behind the diverter. The "face" is generally visible to a person looking up at an installed flashing. Optionally, a fascia flange extending upwardly from and behind the "face" and tucked under the fascia can beneficially be provided and is a preferred feature.

There are materials which can be formed into flashings within the scope of the present inventive concept, such as by compression molding of plastic, vacuum molding of plastic, sand molding or shaping and firing of ceramic or clay materials, lay-up molding, stamping of ductile or bendable metals, injection molding of thermoset or thermoplastic materials. Choices of materials include, but are not limited to, corrosion resistant metals such as copper and anodized aluminum, galvanized metal, metal coated with paint, plastic, or resin, vinyls such as polyvinyl chloride or polyvinylidene chloride, polyolefins such as polyethylene or polypropylene filled with carbon black or other agents to protect against ultraviolet rays, polyesters, polycarbonates, polyethylene terephalate, reinforced fiberglass, and the like.

The term "essentially normal" is used here to indicate that an angle is not very far from being 90 degrees, but exact dimensions needed in a particular situation often depends on fitting the flashing to the type of construction in which it is used. One of the advantages of the present flashing is that it can be made to fit a variety of locations. Some "vertical" walls may not be exactly vertical, but, whether intentionally or accidentally, may have been built slanted away from true vertical. Also, the angles in the flashing are affected by the steepness of the roof. It will be appreciated that the great majority of sloping roofs, when they are longer than just a few feet, are customarily in the slope range of 5-to-12 to 12-to-12. Flashings of this invention are appropriate throughout that range, and even beyond that range as long as rainwater is flowing downwardly to the end of the flashing.

EXAMPLE 1

A flashing about 8" from top to bottom is prepared using galvanized metal substantially as depicted in FIG. 1. It comprises a left flange and a right flange, each being about 5" wide as measured laterally between the apex of the triangular diverter and the outer edge of each of the flanges. From the apex of the triangular diverter to the top of the line of juncture of the two flanges is about 4.5". The base (bottom edge) line of the triangular diverter is about 4.75" long. The apex of the triangular diverter is about ⅗" from the bottom of the configuration. The area under the diverter is sealed off by a triangular "face" portion lying in a plane substantially normal to the plane of the flanges. Behind the diverter and projecting from the back line of the triangular "face" are two small flanges projecting upwardly at about right angles to the triangular "face" to provide additional protection against having debris collect under the flashing when in an installed position. The face portion lies in a plane which is substantially normal to the plane of the wall flanges.

Various alternatives to the specific embodiments disclosed herein may become apparent to practitioners of these relevant arts, upon learning of the present invention, without departing from the spirit and scope of the present inventive concept. The present invention is limited only by the concept as embodied in the following claims.

What is claimed is:

1. A flashing material of a bilateral symmetrical design for use at a low end of the juncture of a vertical wall in abutment with a sloping roof, said flashing material having an upper portion and a lower portion and comprising a right flange and a left flange joined at right angles to each other in their upper portion, one of said flanges being operable for installation as a vertical wall flange on a vertical wall, and the other flange being operable for installation as a sloping wall flange on a sloping roof, and a triangular diverter of bilateral symmetry spanning, in a leak-proof manner, the lower portions of the two flanges in a plane which lies at an obtuse angle to both of the planes of the vertical wall flange and the sloping wall flange, with its upper corner joined in leak-proof manner with the lower end of the line of juncture where said wall flange and roof flange are joined, whereby the symmetrical diverter flashing material is equally operable on either juncture of a vertical wall and a sloping roof, and a triangular portion joined with the lower edge of the said diverter and also with the bottom edges of the two flanges to form a lower face portion for blocking rainwater and debris from getting behind the diverter and the flanges, further characterized in that there are backside portions joined to the lower face portion at about a right angle normal and protruding upwardly from the face portion, for blocking the path of wind-blown water and debris up behind the diverter and the face portion.

2. The flashing of claim 1 wherein the flashing is constructed of corrosion resistant metal.

3. The flashing of claim 1 wherein the flashing is constructed of galvanized metal.

4. The flashing of claim 1 wherein the flashing is constructed of rust-proof metal.

5. The flashing of claim 1 wherein the flashing is constructed of copper.

6. The flashing of claim 1 wherein the flashing is constructed of molded ceramic material.

7. The flashing of claim 1 wherein the flashing is constructed of clay.

8. The flashing of claim 1 wherein the flashing is constructed of molded resin-impregnated fiberglass.

9. The flashing of claim 1 wherein the flashing is constructed of polymer.

10. The flashing of claim 1 wherein the flashing is constructed of compression-molded polymer.

11. The flashing of claim 1 wherein the flashing is constructed as a unitary structure.

12. The flashing of claim 1 wherein the flashing is constructed to fit a roof slope within the range of 4.5-to-12 to 12.5-to-12.

13. The flashing of claim 1 wherein the symmetrical diverter is attached to a previously prepared flashing in a manner which prevents leakage onto the areas in need of protection from rainwater.

14. A flashing material for the juncture of a vertical wall and a sloping roof, said flashing material comprising a vertical wall flange, a sloping roof flange, and a diverter part, said vertical wall flange and sloping roof flange having, in an installed position, a top portion, a lower portion, and a backside for placement along the juncture of a vertical wall and a sloping roof, said vertical wall flange and sloping roof flange lie in planes which are essentially perpendicular to each other and meet in a leak-proof manner at their upper portions along a line which extends down to the said diverter part, an essentially triangular diverter part spanning, in a leak-proof manner, the lower portions of the vertical wall flange and the sloping roof flange in a plane which lies at an obtuse angle to both the planes of the vertical wall flange and the sloping wall flange, with its upper corner joined in a leak-proof manner with the lower end of the line where said wall and roof parts are joined, and the two lower corners of the diverter part extending to the lower portions of the wall flange and the roof flange, with one edge of the diverter joined in a leak-proof manner to the wall flange and another edge of the diverter joined in a leak-proof manner to the roof flange, and wherein there is, additionally, a lower portion of the diverter which extends from its lower edge, in a plane essentially horizontal to the ground, and toward the back, for blocking the path of wind-blown water to the juncture of the wall and roof behind the diverter, further characterized in that the construction is of bilateral symmetry along a line of symmetry extending from the top of the flanges to the bottom of the diverter at the middle of the lower edge thereof, whereby either of the flanges can be installed as a roof flange or as a vertical wall flange whereby the symmetrical diverter flashing material is equally operable on either of a left-hand or right-hand juncture of a vertical wall and a sloping roof, and whereby the diverter is symmetrical with respect to the said line of bilateral symmetry and wherein additional protection against rain and debris from getting behind the flashing is provided by vertically protruding parts affixed to the said horizontally positioned bottom part.

15. The flashing material of claim 14 wherein the material from which the flashing is constructed is corrosion resistant metal, galvanized metal, plastic, copper, ceramic material, roofing clay, resin-impregnated fiberglass, plastic, or polymer.

16. The flashing material of claim 14 wherein the flashing is constructed to fit a roof slope which is within the range of 4.5-to-12 to 12.5-to-12.

* * * * *